US008342236B2

(12) United States Patent
Bienfang et al.

(10) Patent No.: US 8,342,236 B2
(45) Date of Patent: Jan. 1, 2013

(54) BLAST HOLE DRILL BIT CAROUSEL AND A BLAST HOLE DRILL INCLUDING A BLAST HOLE DRILL BIT CAROUSEL

(75) Inventors: David T. Bienfang, Racine, WI (US); Bret A. Tarnowski, West Allis, WI (US); Nathaniel A. Falendysz, Racine, WI (US)

(73) Assignee: Bucyrus International Inc., Milwaukee, WI (US)

( * ) Notice: Subject to any disclaimer, the term of this patent is extended or adjusted under 35 U.S.C. 154(b) by 486 days.

(21) Appl. No.: 12/559,979

(22) Filed: Sep. 15, 2009

(65) Prior Publication Data

US 2010/0071958 A1 Mar. 25, 2010

Related U.S. Application Data

(60) Provisional application No. 61/098,437, filed on Sep. 19, 2008.

(51) Int. Cl.
*E21B 19/00* (2006.01)

(52) U.S. Cl. ..... 166/77.51; 414/22.66

(58) Field of Classification Search ..... 166/379, 166/377, 77.51, 85.5; 414/22.51, 22.66
See application file for complete search history.

(56) References Cited

U.S. PATENT DOCUMENTS

| | | | | |
|---|---|---|---|---|
| 3,493,061 | A * | 2/1970 | Gyongyosi | 175/52 |
| 3,805,463 | A | 4/1974 | Lang et al. | |
| 3,860,126 | A | 1/1975 | Neimark et al. | |
| 3,913,753 | A * | 10/1975 | Swartz et al. | 414/22.66 |
| 3,920,087 | A | 11/1975 | Hisey et al. | |
| 3,944,300 | A | 3/1976 | Learmont et al. | |
| 3,977,480 | A | 8/1976 | Hilding | |
| 4,321,746 | A | 3/1982 | Grinage | |
| 5,931,231 | A | 8/1999 | Mock | |
| 5,931,238 | A | 8/1999 | Gilmore et al. | |
| 6,454,026 | B1 | 9/2002 | Shofner | |
| 7,886,846 | B2 * | 2/2011 | Pires | 175/52 |
| 2006/0162963 | A1 * | 7/2006 | Hagemeyer et al. | 175/52 |

* cited by examiner

*Primary Examiner* — Giovanna Wright
*Assistant Examiner* — Kipp Wallace
(74) *Attorney, Agent, or Firm* — Foley & Lardner LLP

(57) ABSTRACT

A drill bit carousel for use on a blast hole drill includes a base structure that movably supports a plurality of drill receptacles. The drill bit carousel is movable between a storage position and at least one exchange position. In the exchange position, one of the drill receptacles is aligned with a centerline of a drill pipe string. In the storage position, the drill bit carousel is clear of the centerline of the drill pipe string.

17 Claims, 9 Drawing Sheets

BLAST HOLE DRILL BIT CAROUSEL AND A BLAST HOLE DRILL INCLUDING A BLAST HOLE DRILL BIT CAROUSEL

CROSS-REFERENCE TO RELATED APPLICATION

This application claims the priority benefit of U.S. Provisional Patent Application No. 61/098,437 filed on Sep. 19, 2008, which is fully incorporated herein by reference.

STATEMENT CONCERNING FEDERALLY SPONSORED RESEARCH OR DEVELOPMENT

Not applicable.

FIELD OF THE INVENTION

This invention relates to exchanging drill bits on large drilling machines, and particularly to a mechanism for exchanging drill bits on a blast hole drill.

BACKGROUND OF THE INVENTION

A type of drilling unit known as a blast hole drill is used in surface mining and quarrying operations. The unit is typically mobile, being mounted on a vehicle that travels on wheels or tractor crawlers. Blast hole drills and other similar drilling rigs use drill pipe strings that are made up of drill pipes that are threaded end to end. The first pipe, i.e. the first pipe entering the hole being drilled, in the drill pipe string has an upper end connected to the next pipe in line and a lower end, on which a drill bit is mounted.

The drill bit is typically threadably connected to the lower end of the first pipe and after a period of use becomes dull due to the constant wear of the drilling operation. As a result, the drill bit must be replaced on a regular basis in order to quickly and efficiently drill holes. Replacement of the drill bit is a time consuming operation requiring workers to manually remove the used drill bit and mount a new drill bit onto the lower end of the first pipe. A need exists for an improved method and equipment that simplifies changing out these drill bits.

SUMMARY OF THE INVENTION

One embodiment of the present invention is a drill bit carousel for use on a blast hole drill. The drill bit carousel includes a base structure that movably supports a plurality of drill receptacles. The drill bit carousel is movable between a storage position and at least one exchange position. In the exchange position, one of the drill receptacles is aligned with a centerline of a drill pipe string. In the storage position, the drill bit carousel is clear of the centerline of the drill pipe string.

Other aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE PREFERRED EMBODIMENT

Figure 1:
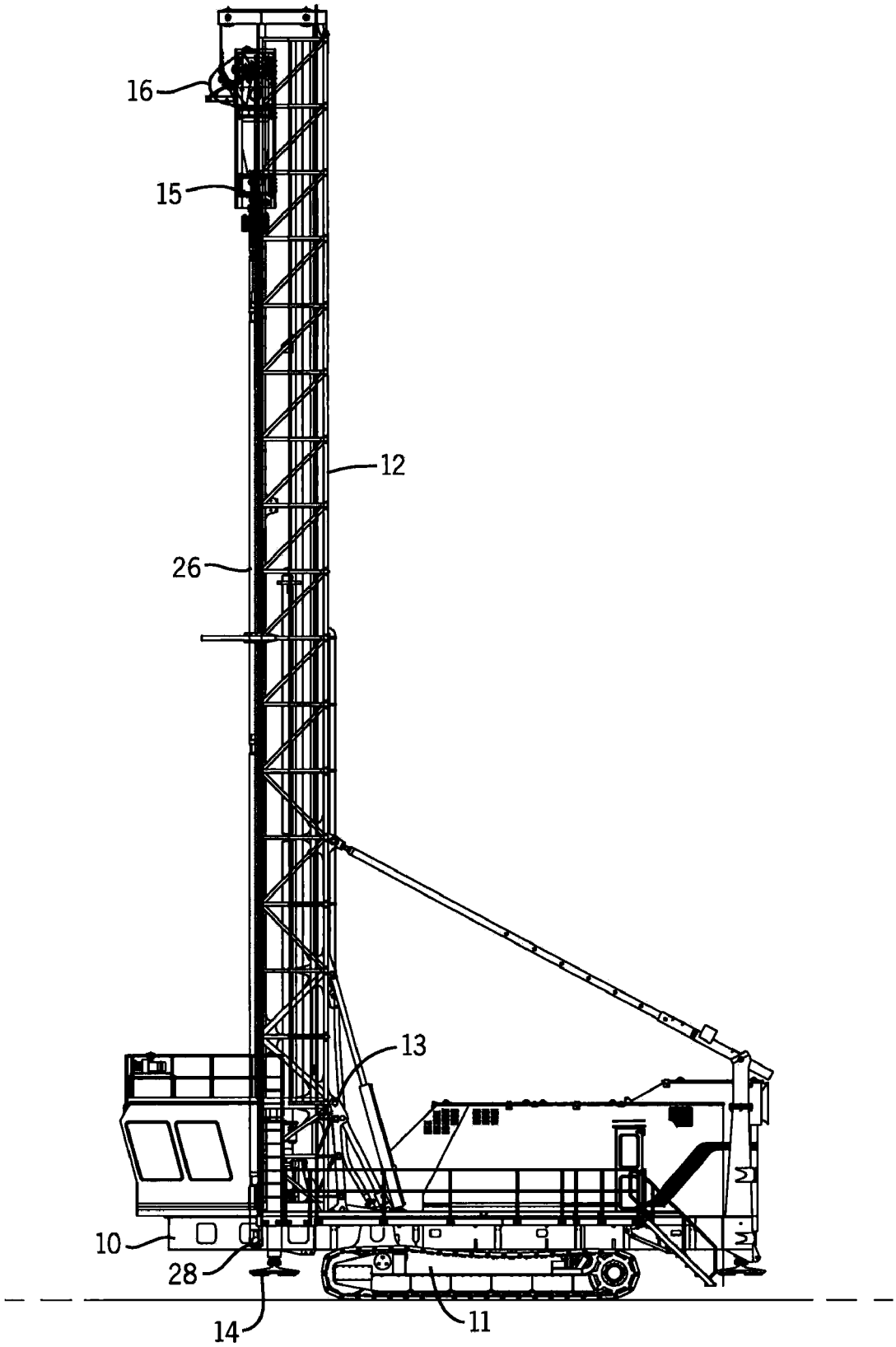
FIG. 1 is a perspective view of a blast hole drill.
Figure 2:
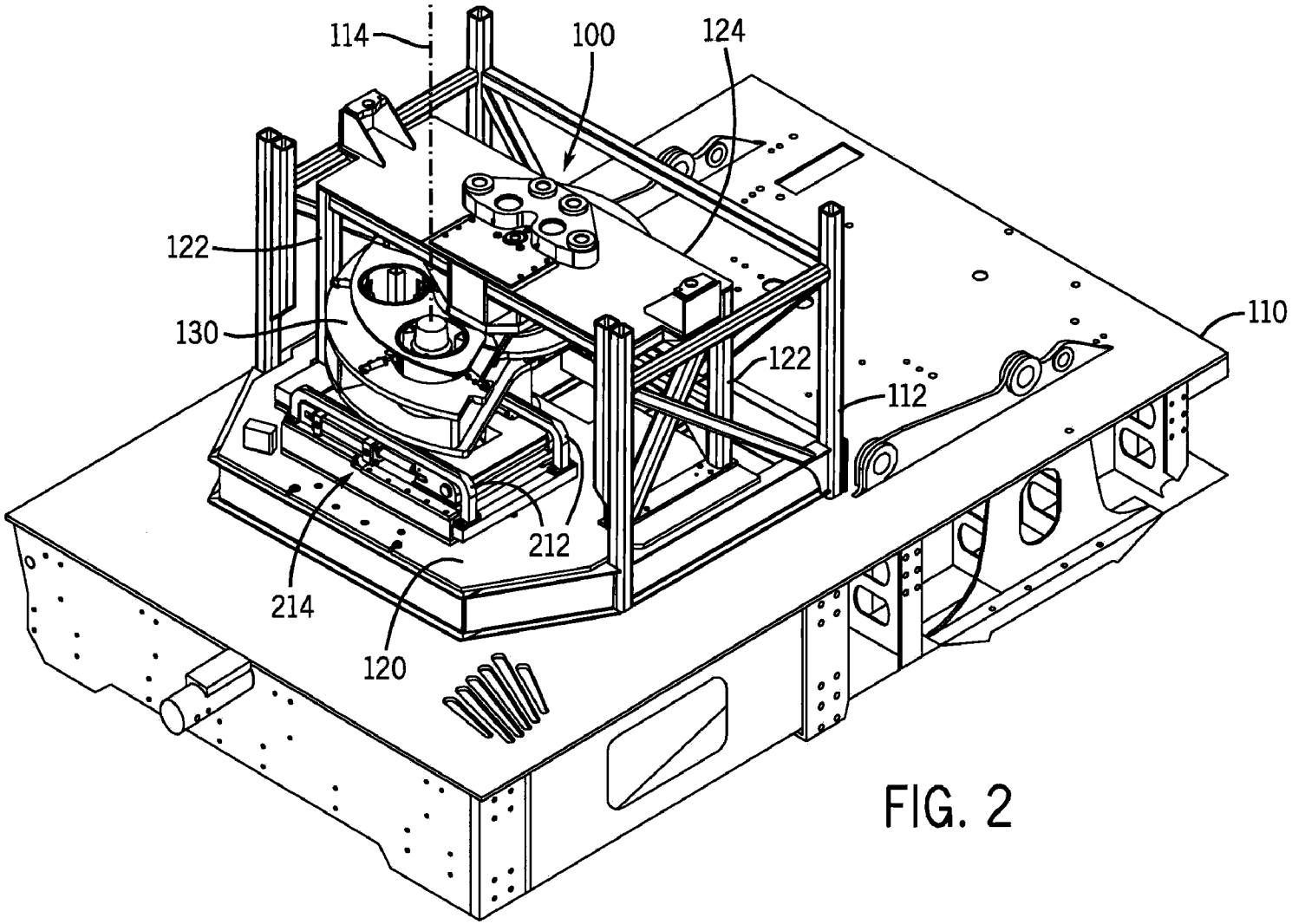
FIG. 2 is a perspective view of a portion of a blast hole drill incorporating the present invention.

As shown in FIG. 1, a blast hole drill, such as a Bucyrus Series 49 Blasthole Drill available from Bucyrus International, Inc. in South Milwaukee, Wis., typically will include a main deck frame 10 supported on crawler tractors 11 and mounting a mast 12 supported on a pivot 13 attached to the deck frame 10. During drilling operation, the drill unit is supported on jacks 14. A rotary drill head 15 is mounted on a pull-down mechanism 16 on the mast 12. The pull-down mechanism 16 travels up and down the side cords of the mast 12 on a rack of teeth. The drill head 15 includes a rotary drive which engages with the top of a drill pipe string comprising drill pipes 26 to rotate a drill bit 28 on the first pipe in the pipe string. The drill head 15 is moved down the mast 12 to force the bit into the earth and is moved up the mast 12 to withdraw the drill pipe string from the earth. A pipe magazine stores pipes 26 added to the pipe string as the drill deepens the hole being drilled. The pipe magazine rests in the back of the mast 12 and swings over the centerline 114 of the drill pipe string to add or remove a drill pipe 26 from the drill pipe string.

A blast hole drill incorporating the present invention includes a drill bit carousel assembly 100, such as shown in FIGS. 2-9, that exchanges the drill bit 28 on the end of the drill pipe string. The carousel assembly 100 is mounted to the drill deck 110 at the base of the mast 112 adjacent the centerline 114 of the drill pipe string extending through an opening 116 of the deck 110. The drill pipe string passes through the deck opening 116 to drill a hole in the ground. The carousel assembly 100 includes a base 120 that supports a rotatable drill bit carousel 130 that can be indexed over the deck opening 116 for receiving and dispensing drill bits 28.

The base 120 is mounted on the drill deck 110 to support and attach the carousel assembly 100 to the blast hole drill. The actual structure of the base 120 is dependent upon the model of the drill and will have many variations depending upon the structure and constraints of the particular drill. In the embodiment shown in FIGS. 3-9, the base 120 includes four legs 122 extending from the deck 110 and supporting a support plate 124 extending the length of the carousel assembly 100. The support plate 124 supports a drive motor 126 that rotates the drill bit carousel 130 and an actuation stop 128 that locks the drill bit carousel 130 at index locations.

Figure 5:
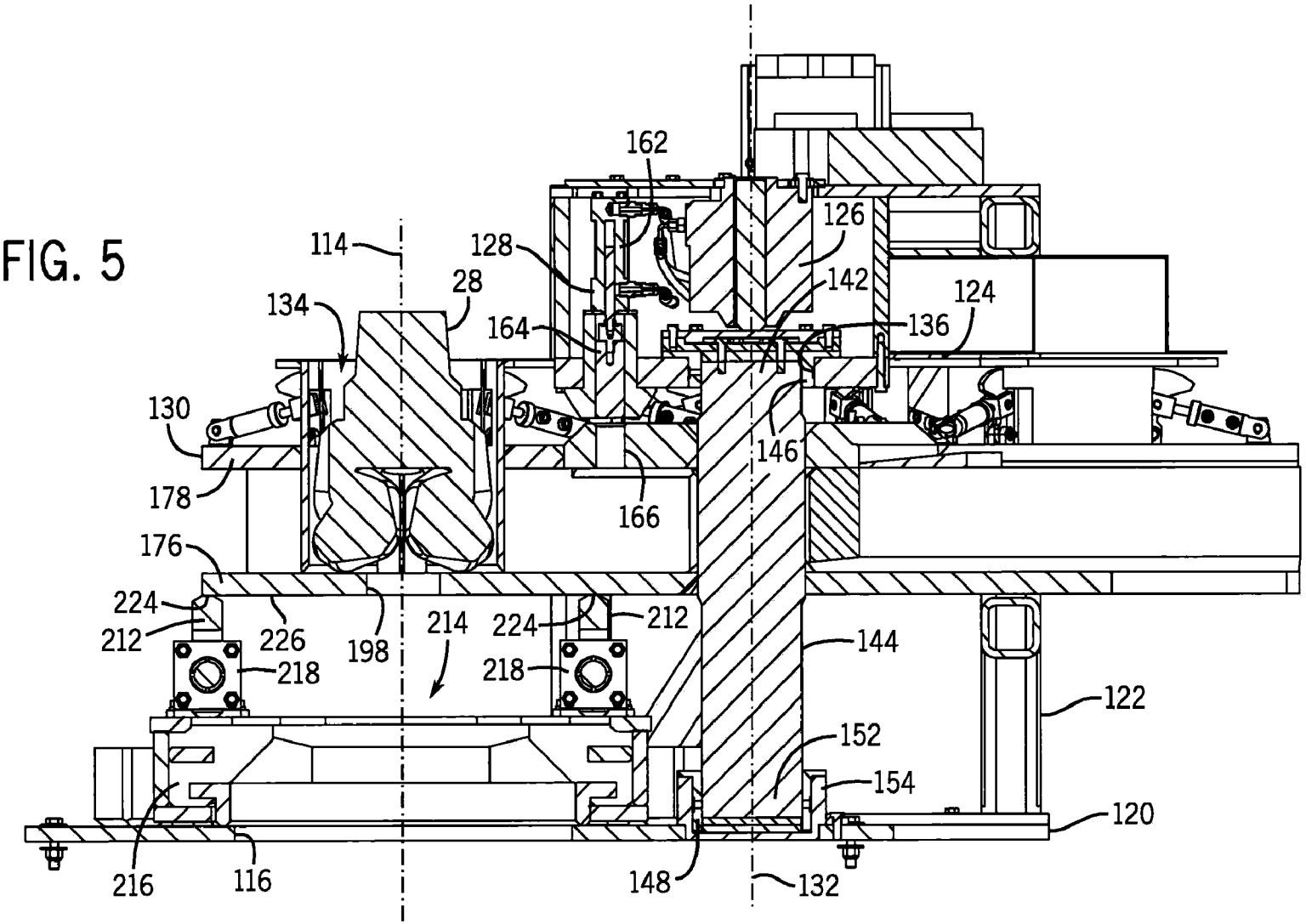
FIG. 5 is a sectional view along line 5-5 of FIG. 3.

As shown in FIG. 5, the drill bit carousel 130 is fixed to a rotatable spindle 144 which rotates about a spindle axis 132 of rotation. An opening 136 formed through the support plate 124 receives an upper end 142 of a rotatable spindle 144 supporting the drill bit carousel 130. Preferably, a bushing 146, or bearings, mounted to the support plate 124 radially supports the upper end 142 of the rotatable spindle 144 while minimizing friction. A lower end 152 of the spindle 144 is received in a collar 154 mounted on the deck 110. Preferably, the collar 154 includes bearings or a bushing 148 to minimize friction when the spindle 144 rotates about the spindle axis 132 of rotation.

The drive motor 126 is coupled to the upper end of the spindle 144 and rotatably drives the spindle 144 about the spindle axis 132 to one of a plurality of exchange positions and a storage position. Preferably, the drive motor 126 is directly coupled to the upper end 142 of the spindle 144. However, any method of transmitting rotational force from the drive motor 126 to the spindle 144, such as by gearing, flexible coupling, and the like, can be used without departing from the scope of the invention.

Figure 3:
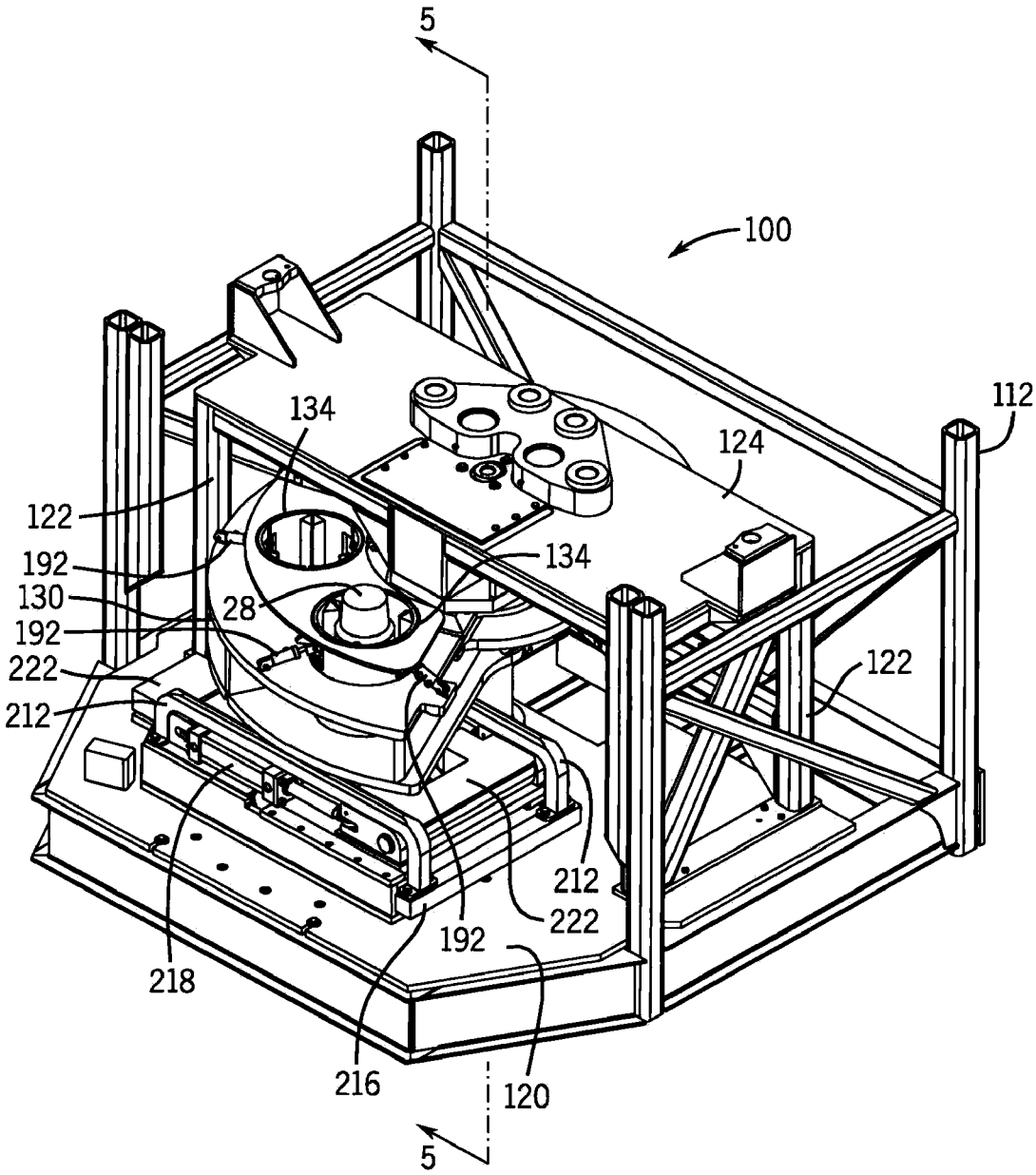
FIG. 3 is a perspective view of the carousel assembly of FIG. 2 with the carousel in an exchange position.
Figure 4:
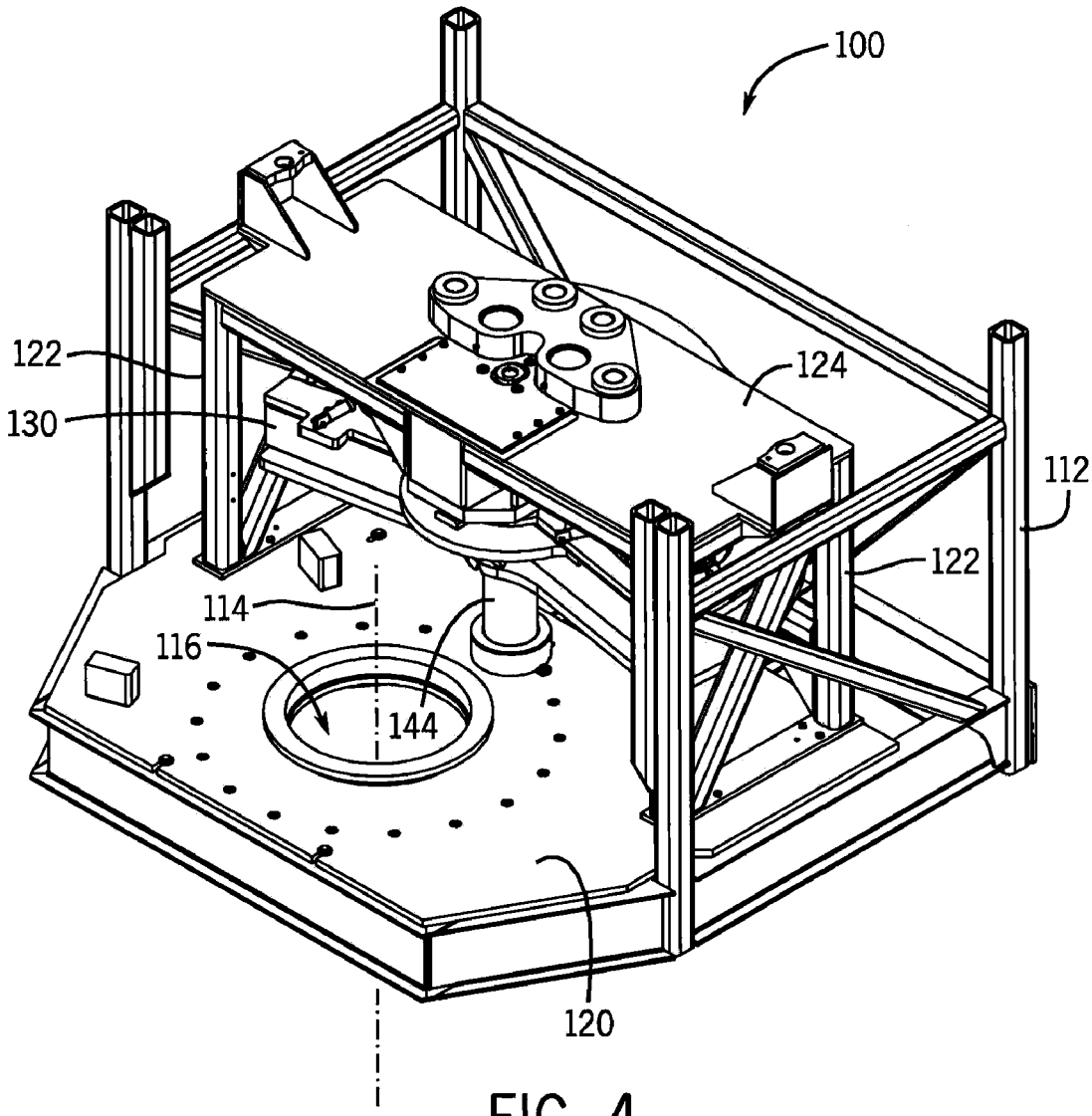
FIG. 4 is a perspective view of the carousel assembly of FIG. 2 with the carousel in the storage position and the tool wrench assembly removed.

The actuation stop 128 mounted to the support plate 124 includes a hydraulic double acting actuator 162 that selectively extends a locking pin 164 into one of a plurality of index openings 166 formed in the drill bit carousel 130. Each of the index openings 166 corresponds to one of the exchange positions, one of which is shown in FIG. 3, or the storage position shown in FIG. 4 of the carousel 130. The locking pin 164 received in an index opening 166 corresponding to one of the exchange positions aligns a bit receptacle 134 with the drill pipe string centerline 114. Advantageously, the locking pin 164 received in an index opening 166 corresponding to one of the exchange positions ensures the bit carousel 130 maintains the position of a bit receptacle 134 directly under the drill pipe string during removal or deposit of a bit in the receptacle 134. Likewise, the locking pin 164 received in the one index opening 166 positioning the bit carousel 130 in the storage position maintains the entire bit carousel 130 away from the drill pipe string centerline 114 to avoid interfering with the drilling operation.

The bit carousel 130 extends radially from the spindle 144 below the support plate 124 and includes a plurality of the bit receptacles 134 for receiving drill bits 28. The carousel 130 rotates about the spindle axis 132 from the storage position to one of a plurality of exchange positions. Each exchange position being defined by one of the receptacles 134 aligned with the drill pipe string centerline 114. Preferably, the number of exchange positions corresponds to the number of bit receptacles 134 formed in the bit carousel 130. However, the number of exchange positions can exceed the number of bit receptacles 134 if drill bits 28 are loaded into the receptacles 134 or removed from the receptacles 134 from a position not aligned with the drill pipe string centerline 114.

Figure 6:
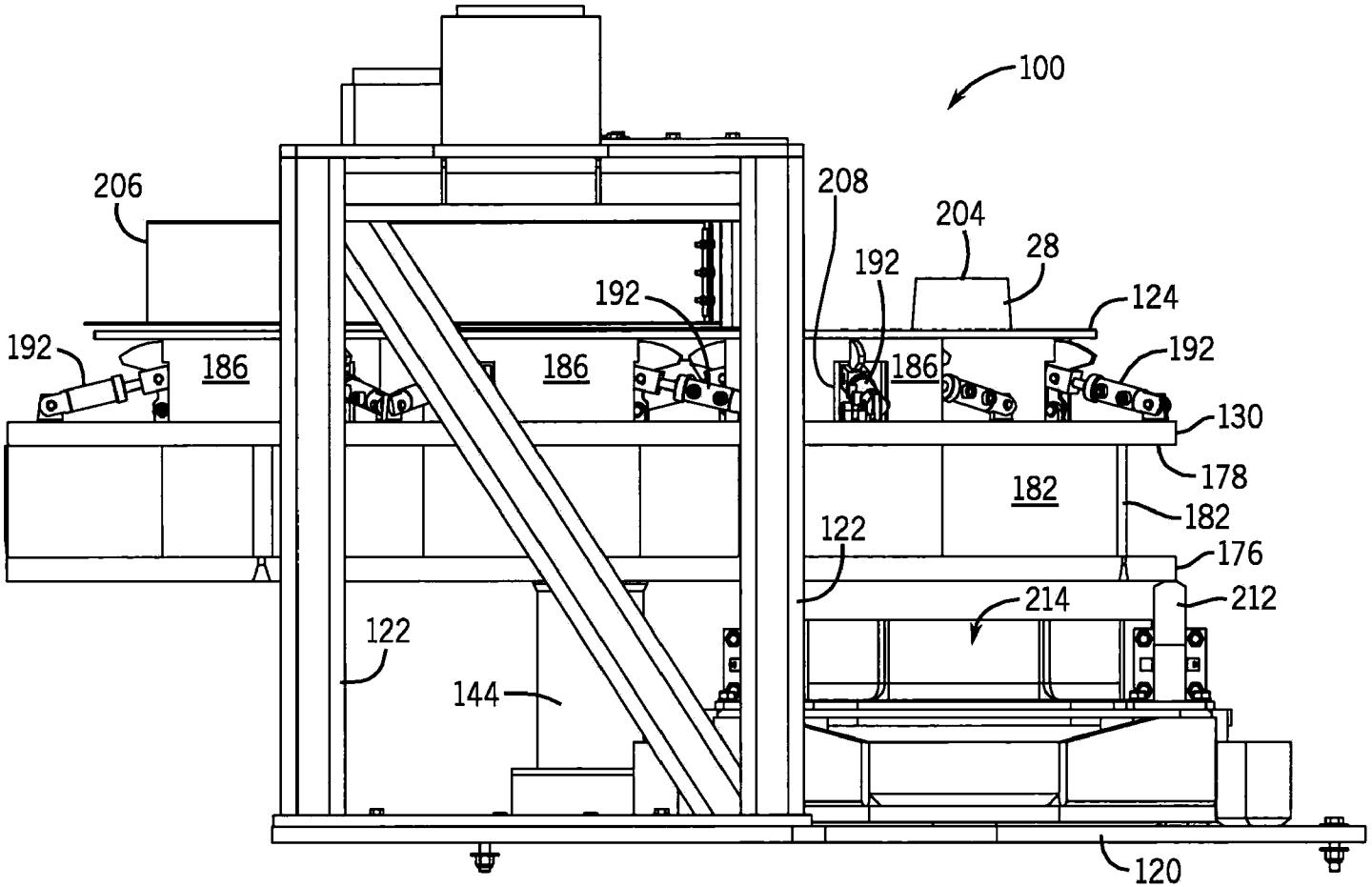
FIG. 6 is a side view of the carousel assembly of FIG. 3.
Figure 7:
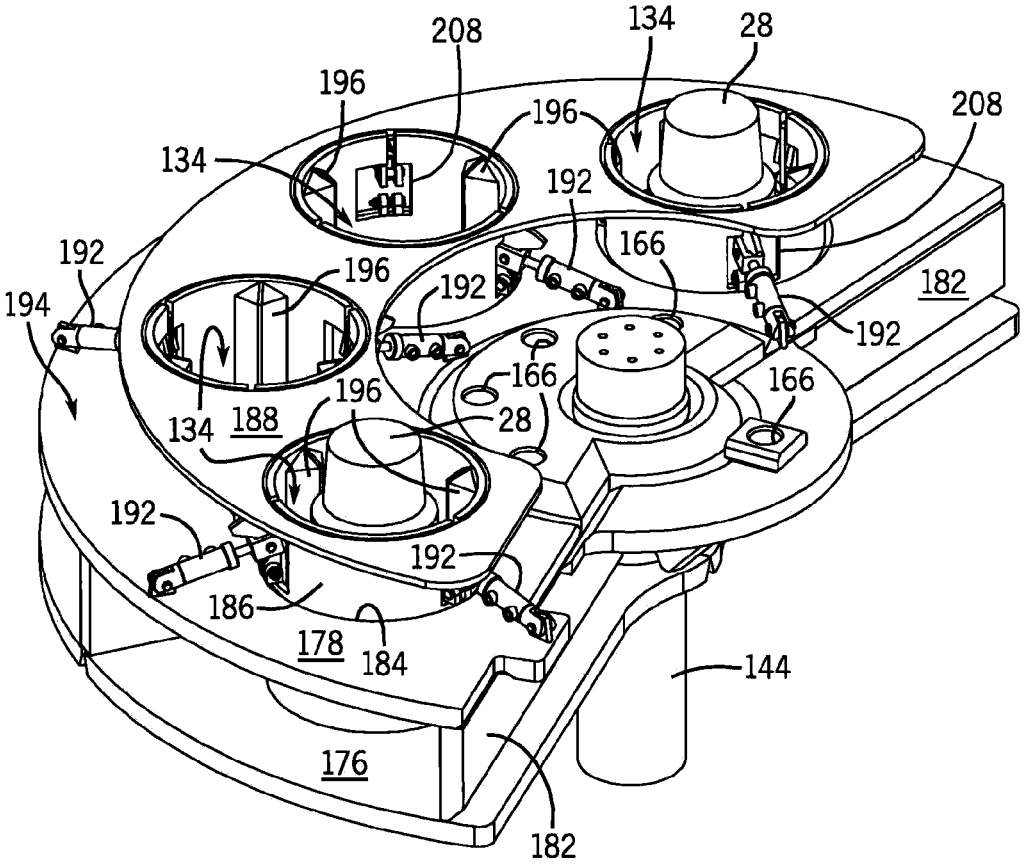
FIG. 7 is a top perspective view of the carousel of FIG. 3.
Figure 8:
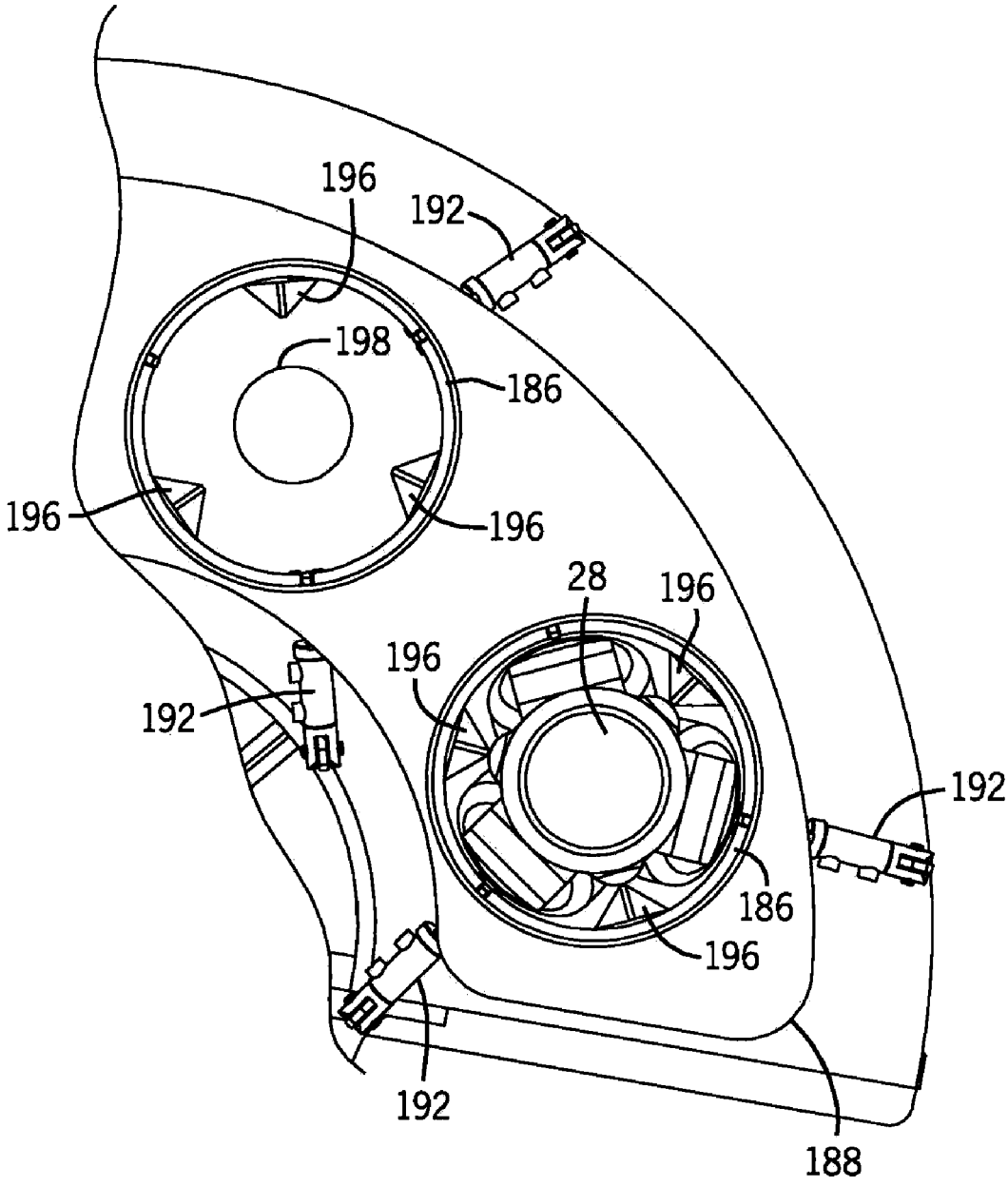
FIG. 8 is a top view of a drill receptacle shown in FIG. 7.
Figure 9:
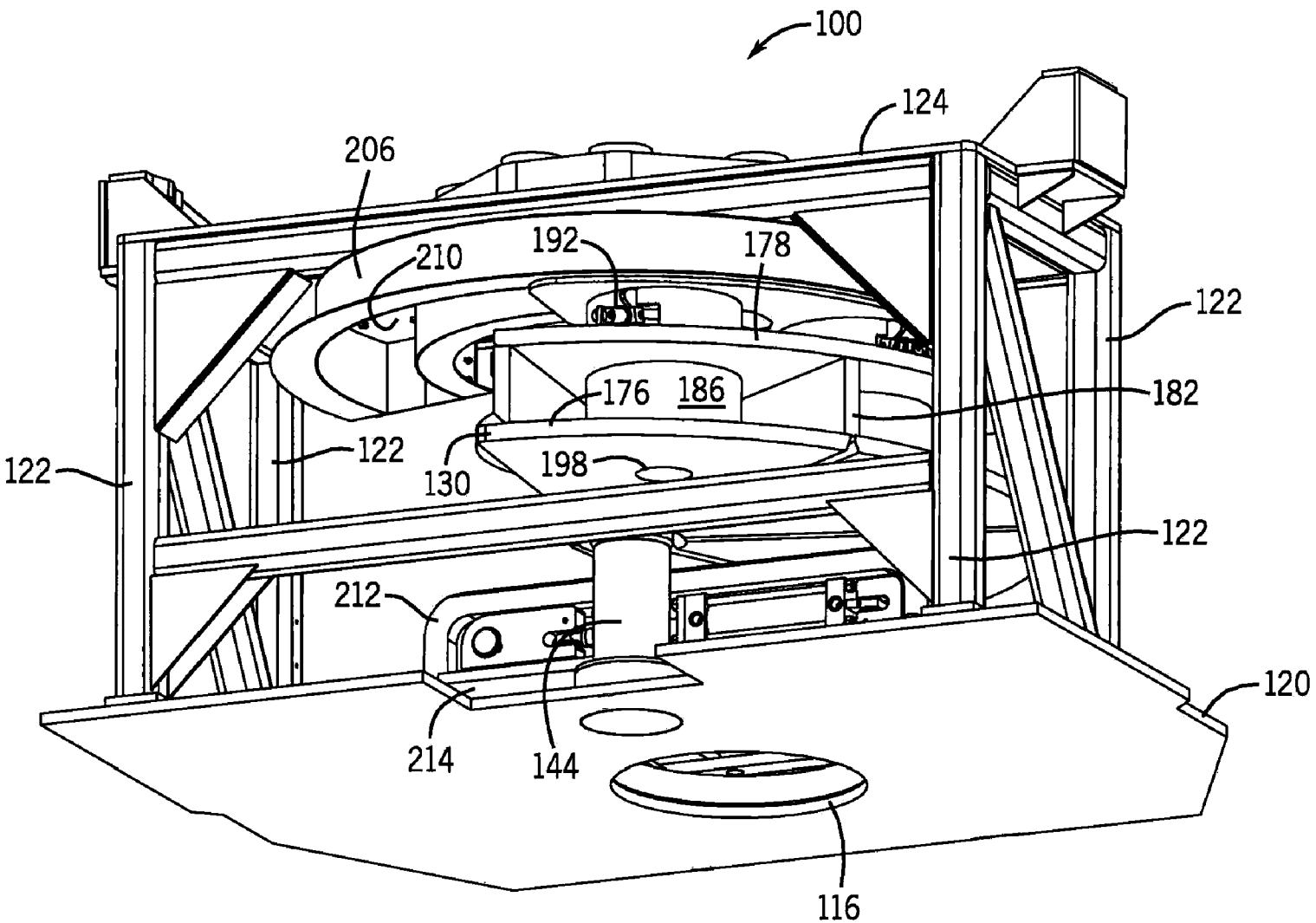
FIG. 9 is a bottom perspective view of the carousel assembly of FIG. 3.

As shown in FIGS. 6-8, an embodiment of the bit carousel 130 includes a semi-circular lower plate 176. The lower plate 176 is fixed to the spindle 144, such as by welding, and is coaxial with the spindle axis 132 of rotation. A semi-circular upper plate 178 is spaced from the lower plate 176 by diaphragms 182 welded to the lower and upper plates 176, 178. Circular apertures 184 formed in the upper plate 178 receive cylindrical drill bit sleeve 186. Each drill bit sleeve 186 defines a bit receptacle 134 for receiving a drill bit 28. A top plate 188 fixed to the upper edge of the sleeves 186 protects hydraulic locks 192 fixed to an upper surface 194 of the carousel upper plate 178 from debris falling from a spent drill bit.

Each drill bit sleeve 186 is supported by the lower plate 176 and extends above the upper plate 178 through the circular apertures 184. Drill stops 196 extending into the cylindrical bit receptacle 134 along the length of the sleeve 186 resists rotation of the drill bit 28 in the receptacle 134 when the drill pipe is being threaded onto or off of the drill bit 28 in the receptacle 134. A hole 198 shown in FIGS. 8 and 9 formed in each receptacle 134 through the lower plate 176 and coaxial with the corresponding sleeve 186 allows fluid and debris from a spent drill bit to be easily cleaned out of the drill bit receptacle 134. Three hydraulic locks 202 extend through apertures 208 formed through each sleeve 186 and engage the drill bit 28 received in the receptacle 134 to position and hold the drill bit 28 in the sleeve 186 for engaging the lower end of the first pipe.

In the storage position, the upper end 204 of the drill bits 28 are disposed in a semi-annular hood 206 fixed to the base support plate 124. An arcuate slot 210 formed in the hood 206 receives the upwardly extending upper ends 204 of the drill bits 28 as the carousel 130 rotates toward the storage position. Advantageously, the hood 206 protects the drill bits 28 disposed in the receptacles 134 from harmful debris when in the storage position.

In the exchange positions, the bit carousel 130 is supported over the opening 116 in the deck 110 by two support rails 212 adjacent the opening 116. Preferably, one support rail 212 is mounted adjacent the deck opening 116 between the deck opening 116 and the spindle 144 and the other support rail 212 is parallel to the first support rail 212 on an opposing side of the deck opening 116. Advantageously, upper surfaces 224 of the support rails 212 engage the lower surface 226 of the bit carousel lower plate 176 to support the bit carousel 130 over the opening 116 in the deck 110 without interfering with the tool wrench operation.

Preferably, the support rails 212 form part of tool wrench assembly 214 mounted on the deck 110. The tool wrench assembly 214 includes a base 216 mounted to the deck 110, such as by welding, bolts, and the like. Hydraulic actuators 218 mounted on the base 216 urge slidably mounted jaws 222 into engagement with the drill pipe string to add and remove drill pipe. The support rails 212 are mounted to the tool wrench assembly base 216 and extend above the tool wrench jaws 222 on opposing sides of the deck opening 116 tangential to the bit carousel 130. Of course, the support rails 212 can be mounted directly to the deck 110 independent of the tool wrench assembly 214 without departing from the scope of the invention.

In use, a blast hole drill incorporating the present invention, includes a drill bit 28 in at least one of the drill bit receptacles 134 in the bit carousel 130. When a drill bit 28 on the end of the drill pipe string requires replacement, the spent drill bit 28 is raised to the surface above the bit carousel 130. The bit carousel 130 is rotated from the storage position to an exchange position locating an empty drill bit receptacle 134 beneath the spent drill bit 28. The spent drill bit 28 is lowered by the operator into the empty drill bit receptacle 134. Once the spent drill bit 28 is lowered into the empty drill bit receptacle 134, the operator engages the drill bit locks 192 associated with the drill bit receptacle 134 with the drill bit 28 and rotates the drill pipe to unscrew the spent drill bit 28 from the drill pipe. After the spent drill bit 28 is detached from the drill pipe, the drill pipe is raised and the bit carousel 130 is rotated to another exchange position locating a fresh drill bit 28 beneath the drill pipe. Of course, the tool wrench assembly 214 can be used to loosen the spent drill bit 28 relative to the drill pipe prior to depositing the spent drill bit 28 into the drill bit receptacle 134.

The fresh drill bit 28 is attached to the drill pipe by the operator lowering the rotating drill pipe onto the fresh drill bit 28 to thread the fresh drill bit 28 onto the end of the drill pipe. Once the fresh drill bit 28 is attached to the drill pipe, the operator releases the drill bit locks 192 securing the drill bit 28 and raises the fresh drill bit 28 out of the drill bit receptacle 134 by raising the drill pipe. After the fresh drill bit 28 is clear of the drill bit carousel 130, the drill bit carousel 130 is rotated to the storage position and the drill pipe and fresh drill bit 28 are lowered through the deck opening 116 to continue drilling. Advantageously, the drill bit carousel assembly 100 allows the operator to change the drill bit 28 from the comfort of the operator cab and eliminates manual operations to minimize the time required to change out drill bits 28 during a drilling operation.

While there has been shown and described what are at present considered the preferred embodiments of the invention, it will be obvious to those skilled in the art that various changes and modifications can be made therein without departing from the scope of the invention defined by the appended claims.

We claim:

1. A blast hole drill comprising:

a deck frame including an opening for passing a drill pipe therethrough along a drill pipe centerline;

a drill bit carousel fixed relative to said deck frame adjacent said drill pipe centerline, said drill bit carousel including a plurality of drill bit receptacles, said drill bit carousel being movable between a storage position and at least one exchange position, in said exchange position one of said drill bit receptacles is aligned with said centerline of said drill pipe, and in said storage position said drill bit carousel is clear of said centerline of said drill pipe;

at least one of said drill bit receptacles having a sleeve extending above an upper surface of said carousel; and at least one hydraulic lock associated with the drill bit receptacle and configured to releasably engage a drill bit on the drill pipe, the hydraulic lock including a hydraulic cylinder that extends through an aperture in the sleeve.

2. The blast hole drill as in claim 1, in which said drill bit carousel is fixed to a spindle and rotatable between said storage position and said least one exchange position.

3. The blast hole drill as in claim 1, including a hood having an arcuate slot receiving an upper end of a drill bit disposed in at least one of said drill receptacles when said carousel is in said storage position.

4. The blast hole drill as in claim 1, including at least one support rail supporting said carousel when said carousel is in said at least one exchange position.

5. The blast hole drill as in claim 1, in which said drill bit carousel includes a drive motor driving said carousel between said storage position and said least one exchange position.

6. The blast hole drill as in claim 1, in which each of said drill bit receptacles is dimensioned for receiving one drill bit.

7. The blast hole drill as in claim 1, in which said carousel includes index openings and a plurality of exchange positions, each of said index openings corresponding to one of said exchange positions, wherein a locking pin is received in one of said index openings to align one of said exchange positions with said drill pipe centerline.

8. The blast hole drill as in claim 1, in which at least one drill stop extends inwardly from said sleeve into said at least one drill bit receptacle to prevent rotation of the drill bit disposed in said at least one drill bit receptacle.

9. The blast hole drill as in claim 1, in which at least one of said drill bit receptacles includes a hole allowing removal of fluid and debris from said drill bit receptacle.

10. The blast hole drill as in claim 1, including a mast supported by said frame and supporting said drill pipe.

11. A blast hole drill comprising:

a deck frame including an opening for passing a drill pipe therethrough along a drill pipe centerline;

a drill bit carousel fixed relative to said deck frame adjacent said drill pipe centerline, said drill bit carousel including a plurality of drill bit receptacles;

at least one of said drill bit receptacles having a sleeve extending above an upper surface of said carousel; and at least one hydraulic lock associated with the drill bit receptacle and configured to releasably engage a drill bit on the drill pipe, the hydraulic lock including a hydraulic cylinder that extends through an aperture in the sleeve.

12. A drill bit carousel mountable in a blast hole drill as recited in claim 11, said drill bit carousel being movable between a storage position and at least one exchange position, in said exchange position one of said drill receptacles is aligned with a centerline of a drill pipe, and in said storage position said drill bit carousel is clear of said centerline of said drill pipe.

13. The drill bit carousel as in claim 12, in which said drill bit carousel includes a drive motor driving said carousel between said storage position and said least one exchange position.

14. The drill bit carousel as in claim 11, in which each of said drill bit receptacles is dimensioned for receiving one drill bit.

15. The drill bit carousel as in claim 12, in which said carousel includes index openings and a plurality of exchange positions, each of said index openings corresponding to one of said exchange positions, wherein a locking pin is received in one of said index openings to align one of said exchange positions with said drill pipe centerline.

16. The drill bit carousel as in claim 11, in which at least one drill stop extends inwardly from said sleeve into said at least one drill bit receptacle to prevent rotation of a drill bit disposed in said at least one rill bit receptacle.

17. The drill bit carousel as in claim 11, in which at least one of said drill bit receptacles includes a hole allowing removal of fluid and debris from said drill bit receptacle.

* * * * *